United States Patent [19]

Shen

[11] Patent Number: 4,872,398

[45] Date of Patent: Oct. 10, 1989

[54] AIR VENT THROAT OF INDOOR VENTILATING DEVICE CAPABLE OF PREVENTING NOISE

[76] Inventor: Hsin-Der Shen, 208, Min Shen West Rd., Taipei, Taiwan

[21] Appl. No.: 244,034

[22] Filed: Sep. 14, 1988

[51] Int. Cl.[4] ..... F24F 11/02

[52] U.S. Cl. ..... 98/42.08; 98/42.09; 98/116; 98/DIG. 10; 137/527.8; 181/224; 181/225

[58] Field of Search ..... 98/42.08, 42.04, 42.12, 98/116, 119, DIG. 10; 137/527.6, 527.8; 181/224, 225, 228, 249

[56] References Cited

U.S. PATENT DOCUMENTS

| | | | |
|---|---|---|---|
| 613,516 | 11/1898 | James | 137/527.8 |
| 1,890,758 | 12/1932 | Townsend | 98/42.09 X |
| 1,964,845 | 7/1934 | Dietze et al. | 181/224 X |
| 2,332,552 | 10/1943 | Belanger | 98/116 X |
| 2,780,981 | 2/1957 | Miller | 98/42.08 |
| 2,898,841 | 8/1959 | Knutson et al. | 98/116 |
| 2,930,400 | 3/1960 | Wheatley | 137/527.8 |
| 3,125,286 | 3/1964 | Sanders | 181/224 X |
| 3,394,731 | 7/1968 | Elliott | 137/527.8 |
| 4,040,042 | 8/1977 | Mayer | 126/299 D |

FOREIGN PATENT DOCUMENTS

| | | | |
|---|---|---|---|
| 115539 | 9/1979 | Japan | 98/116 |

*Primary Examiner*—Harold Joyce

[57] ABSTRACT

An improved air vent throat of indoor ventilating device capable of preventing noise where in an outlet throat is installed at the air exhaust port to connect the vent windpipe of the device for bettering the air flow and vibration, a concave check valve toward the direction of the device is provided inside the throat so as to exhaust the air flow which has an action of enlarging the air flowing out through the throat and check valve to prevent the air flowing back into the door when the device is stopped running. The bent windpipe is inwardly extended and gradually enlarged from the air inlet end thereof and then gradually narrowed toward the air outlet and thereof to be an air flow connecting and shifting device so that the exhausted air flow is a laminar flow and the air resistance is minimized through such a shape of the windpipe to improve the noise generated by the air vibration.

2 Claims, 4 Drawing Sheets

AIR VENT THROAT OF INDOOR VENTILATING DEVICE CAPABLE OF PREVENTING NOISE

BACKGROUND OF THE INVENTION:

The indoor ventilating device (indoor ventilator) in general is a prerequisite equipment of modernized housing such as skyscraper and apartment where the dirty air in the closed space such as bathroom, kitchen, toilet, etc. of said housing may be exhausted out of the door through installing the said indoor ventilating device, i.e. the said device is installed on the ceiling of indoor closed space to be connected to the air pipe communicating with the common windpipe installed in the said housing. When the motor of said device is started, the indoor dirty air can be exhausted out of the door through the said air pipe and common windpipe so as to achieve the purpose of freshening the air.

Since the said conventional indoor ventilating device (indoor ventilator) and its accesory, i.e. the air pipe, are designed inappropriately, the noise is always generated to trouble the people very much who are eager to live in a very calm environment. The generation of said noise may be attributed to the following causes:

1. The mechanical noise generated by the motor for the indoor ventilating device; It is resulted from the said motor without strict quality control or used for a long time, the wearing of said motor leads to the bearing coming off, or the dynamic balance between the rotating blades and the bearing center of said motor has not been well adjusted. However, such a mechanical noise may be eliminated through the strict quality control during manufacturing process and the improvement of the strength of the material of the said motor. This point is not the subject matter to be solved by the present invention.

2. The whistling noise of shock wave from the undesirably designed air pipe; it is resulted from the said pipe for the conventional indoor ventilating device which is contrary to the principle of gas dynamics. For the modern people eager for a quiet living environment through positively improving the noise pollution, this whistling noise is really very troublesome.

The present invention is designed to eliminate the whistling noise always derived from the said indoor ventilating device. The present inventor, based on his findings from engrossed study of both structural and gas dynamics for a number of years, developed an improved air vent throat of indoor ventilating device capable of preventing noise for bettering the whistling phenomenon of said device and the drawback of outdoor dirty air flowing back to the closed space indoors.

SUMMARY OF THE INVENTION:

The present invention is related to an improved air vent throat of indoor ventilating device capable of preventing noise which is characterized by the following structure and functions:

An outlet throat is installed at the air exhaust port to connect the bent windpipe of said device for bettering the air flow and vibration, a concave check valve toward the direction of said device is provided inside the said throat so as to exhaust the air flow which has an action of enlarging the air flowing out through said throat and check valve to prevent the air flowing back into the door when the said device is stopped running. The vent windpipe is inwardly extended and gradually enlarged from the air inlet and thereof and then gradually narrowed toward the air outlet and thereof to be an air flow connecting and shifting device so that the exhausted air flow as a laminar flow and the air resistance is minimized through such a shape of said windpipe to improve the noise generated by the air vibration.

Figure 1:
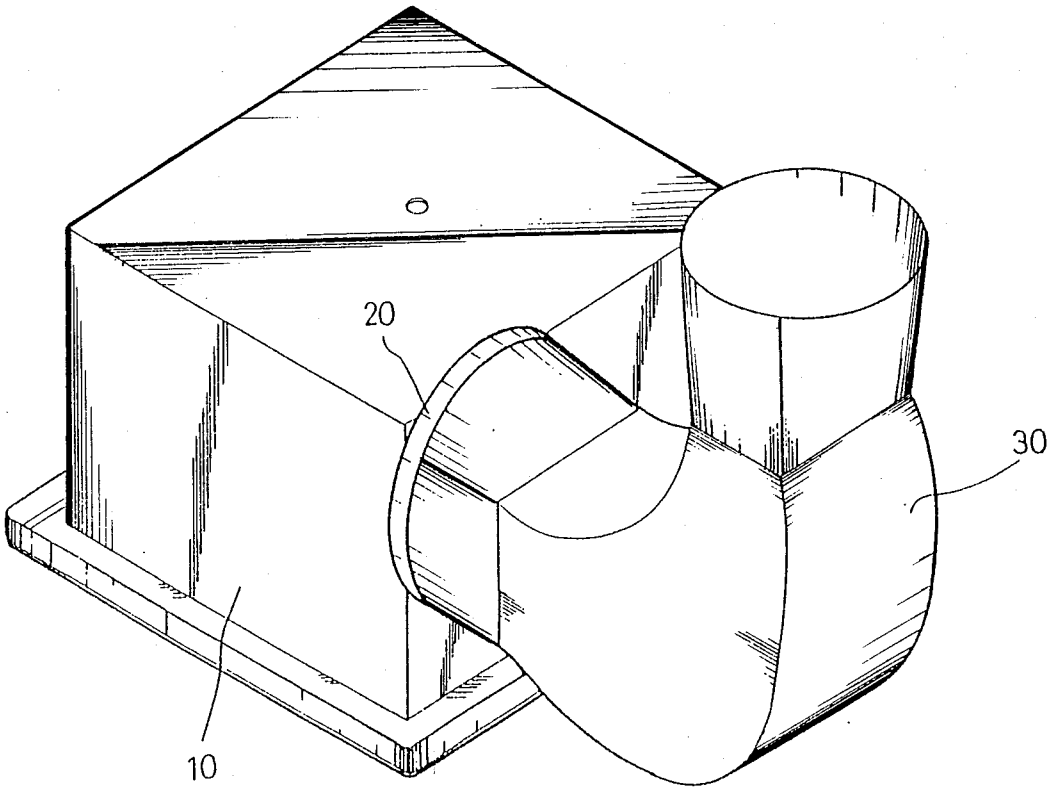
FIG. 1 is an appearance view of the present invention connected to the indoor ventilating device.
Figure 2:
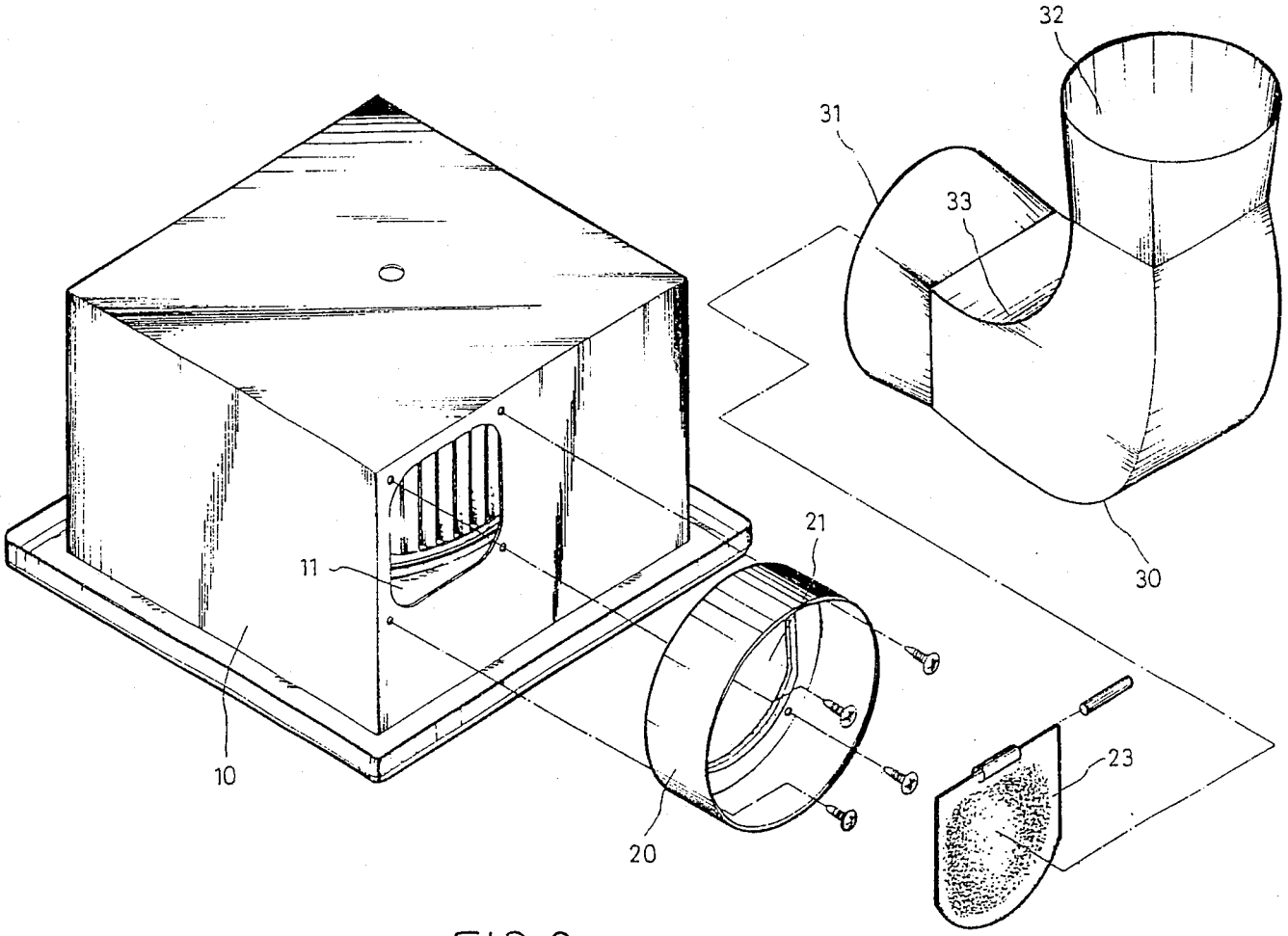
FIG. 2 is a structural combined view of the present invention with the indoor ventilating device.

DETAILED DESCRIPTION OF THE INVENTION:

As shown in FIG. 1 and 2, the improved structure of indoor ventilating device of the present invention consists chiefly of an outlet throat(20) installed at the air exhaust port(11) of indoor ventilating device(10) and a bent windpipe(30) is connected to the said outlet throat(20). When the indoor ventilating device of the present invention is installed on the ceiling of indoor closed space (such as bathroom, kitchen, toilet, etc.), the dirty air indoors can be exhausted out of the door through the said outlet throat(20), bent windpipe(30) and the common windpipe of building so as to achieve the purpose of freshening the indoor air and preventing the noise.

Figure 4:
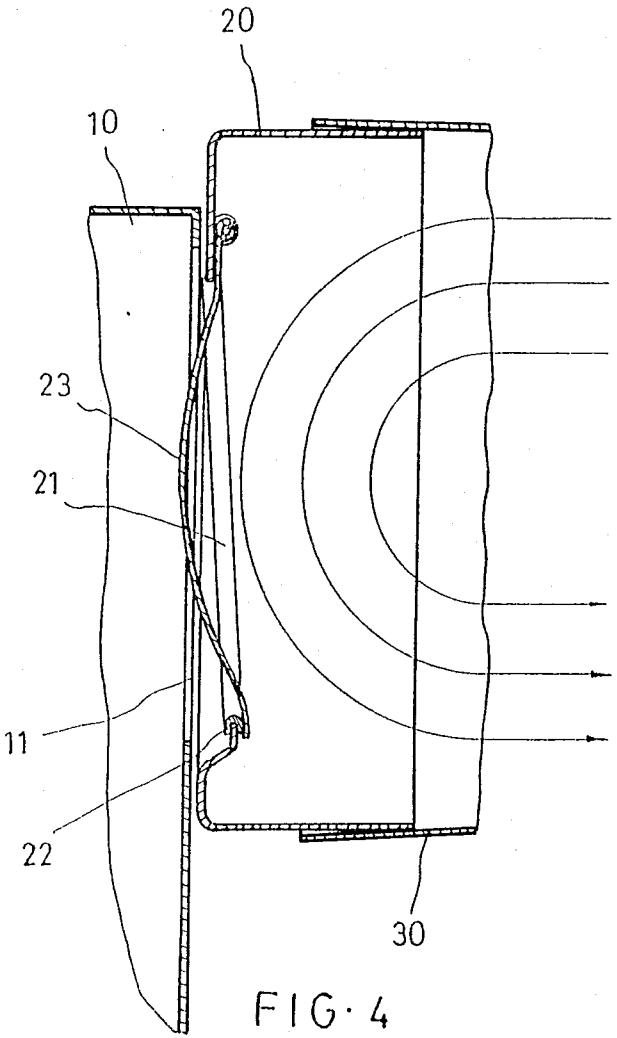
FIG. 4 is an optional view check valve of the present invention with air flow.

As shown in FIG. 2, the outlet throat(20) of the present invention is generally in the shape of hat and connected to the said bent windpipe(30), a hole(21) is provided to the top of said throat(20) to be communicated with the air exhaust port(11) of indoor ventilating device(10). As shown in FIG. 4, the said hole(21) is inclined from a side view and may be naturally closed by a check valve(23) usually through its gravity. An annular rubber sleeve(22) is provided around the periphery of said hole(21) as a buffer for the said check valve(23) to close the said hole(21). The said check valve(23) capable of freely lifting up together with the exhausted air is pivotally installed on the wall at the top end of said hole(21) to cover the said hole(21) as a whole. When the indoor ventilating device stops running, the said check valve(23) naturally and tightly closes the said whole hole(21) so as to prevent the dirty air outdoors from entering into the indoor closed space; and when the indoor ventilating device starts running, the exhausted air blows up the check valve(23) to form an inclination of about 45°–60° to exhaust the air as shown in FIG. 5.

Figure 5:
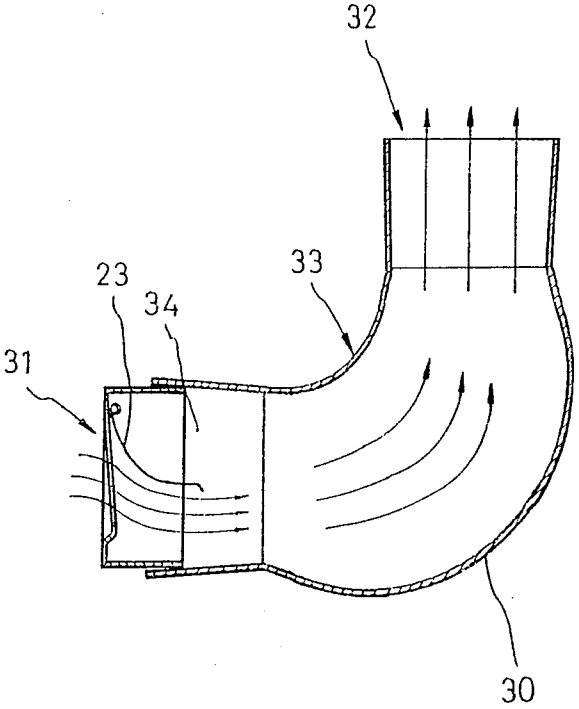
FIG. 5 is an optional view of air flow in the windpipe of the present invention when the indoor ventilating device starts running.

As shown in FIG. 2 and 5, the bent windpipe(30) of the present invention is an extended and bent windpipe with openings at its both ends wherein one end thereof, i.e. the air inlet end(31), is tightly connected to the outlet throat(20), and another end thereof, i.e. the air outlet end(32), is connected to the common windpipe of the building. So for as the shape of said bent windpipe(30) is concerned, it is inwardly extended and gradually enlarged from the air inlet end(31) and then further extended and gradually narrowed toward the air outlet end(32) through the bent portion(33) of which the radial pipe is obviously larger than those at both air inlet end(31) and air outlet end(32), so that the bent windpipe(30) with such a configuration is an air flow connecting and shifting device to let the air flow exhaust as a Laminar flow, minimizes the air resistance in such a windpipe, and improve the noise derived from the air vibration.

The said check valve(23) is a light lamina with a concave arched surface projected outwardly in the direction of air flowing out of the bent windpipe(30) and recessed inwardly in the direction of indoor ventilating device(10) so that when the exhausted air flows to the smooth arched surface of said concave check value(23), the impact of air flow and the air resistance become minimum, and the streamlined design of said concave check valve(23) can minimize the whistling phenomenon of the exhausted air impacting against the said check valve(23). As shown in FIG. 5, when the indoor ventilating device(10) starts running, the exhausted air naturally turns up the said concave check value(23) where from the air flow enters the bent windpipe(30) and may be regarded as a transverse wave going ahead. When the said air flow contacts the inner wall of said bent windpipe(30) with a designed configuration of gradual enlargement, smooth bend and gradual narrowness, it will naturally form a Laminar flow to be very regularly exhausted out of the air exhaust port(32) of said bent windpipe(30), and the said exhaust port may be connected to a straight or bent pipe since the wave is characterized by reflection. So when the wave goes ahead in the bent windpipe(30), the chance of reflecting back the air particles is minimum, and the air resistance derived from the air flow is also minimum. As a result, the air vibration is also minimum, and the noise whistling derived from the bent windpipe can be minimized so as to achieve the purpose of preventing the noise from happening.

Figure 3:
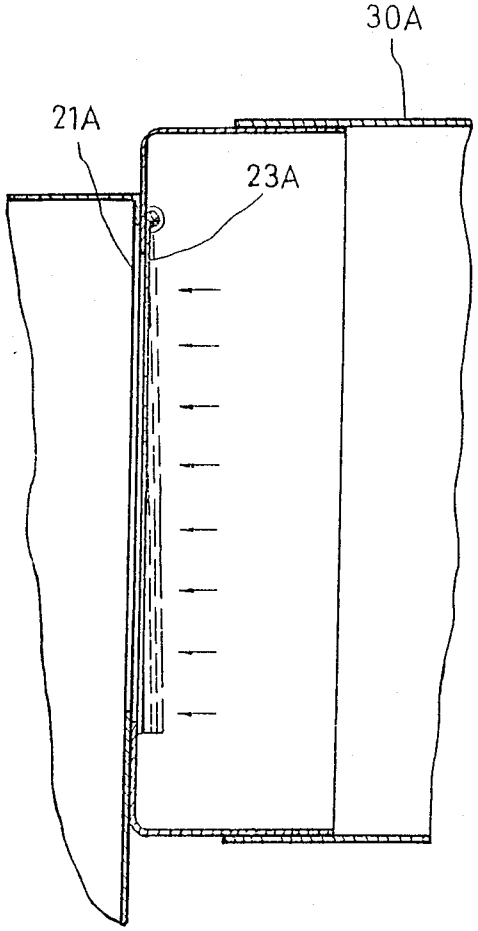
FIG. 3 (Prior Art)
FIG. 3 is an optional view of conventional check valve with air flow.
Figure 6:
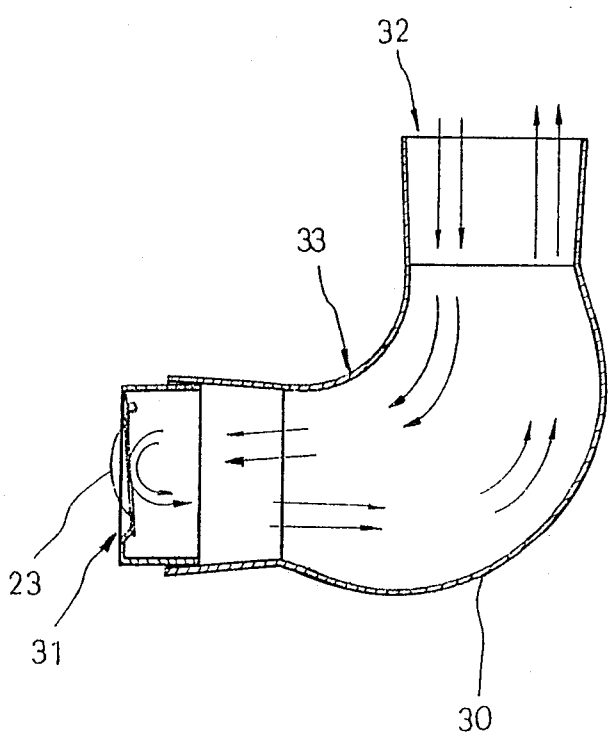
FIG. 6 is an optional view of air flow in the windpipe of the present invention when the indoor ventilating device stops running.

As shown in FIG. 3, the check valve(23A) for the conventional indoor ventilating device(10A) is a flat plate, and the hole(21A) is flat and straight from a side view, so when the outdoor air from the exhauster of neighbors flows back to the said check valve(23A), the particles of said air have a momentum which will hit the said valve(23A) to cause shocks, vibration and noise if it is accumulated to a considerable extent, and because the said wave has a property of superposition. As shown in FIG. 4 and 6, the concave check value(23) is designed in line with the principle of gas dynamics. When the outdoor air flows back to the said valve(23) which will prevent the said air and drive it back through the arched surface design of said valve(23) and the configuration design of the said bent windpipe(30) with three portions of gradual enlargement, smooth bend and gradual narrowness, and then the said air will mix with the new outdoor air flowing back to the said windpipe(30) to weaken the momentum of air particles so that the drawback of conventional check valve frequently causing vibration and noise can be improved. In addition, as shown in FIG. 5, the air exhausted from the indoor ventilating device of the present invention will generate small eddy current in the rear area(34) of check valve(23) but there is no any effect on the noise and vibration because its momentum is very small.

In view of the above, the structure of the present invention is simple but can really improve the drawback of conventional indoor ventilating device generating noise and achieve the purpose of expected function since it has been obviously much bettered.

I claim:

1. In an improved air vent throat of an indoor ventilating device capable of preventing noise comprising:

an outlet throat coupled between an air exhaust port of said device and a bent windpipe which comprises:

said outlet throat having an inclined hole corresponding to the position of said air exhaust port of indoor ventilating device;

a concave check valve pivotally installed on said outlet throat at the top of said inclined hole capable of making the air easily flow out of the device but impossible flow into the device when the indoor ventilating device stops running;

said check valve tightly closes said inclined hole as a whole via its own gravity;

said bent windpipe inwardly extended and gradually enlarged from an air inlet end connected to said outlet throat and then outwardly extended and gradually marging with an air outlet end through a bent portion of said bent windpipe so as to be an air flow connecting and shifting device to exhaust the air flow as a Laminar to avoid the noise derived from the air vibration;

said concave check valve inside said outlet throat includes a concave arched surface outwardly projected in the air flowing out of said bent windpipe and inwardly recessed in the direction of said indoor ventilating device.

2. An improved air vent throat for an indoor ventilating device capable of preventing noise comprising:

an indoor ventilating device having an electric fan, an outlet throat mounted on an air exhaust port;

a bent windpipe extending to and connecting with said outlet throat and exhaust port;

an inclined hole provided on said outlet throat corresponding to the position of said air exhaust port;

a concave check valve pivotally installed at said inclined hole at one end and for making air flow easier out of the said air exhaust port, while restricting air flow from said bent windpipe into said air exhaust port;

an air outlet pipe;

said bent windpipe is continuously extended and gradually enlarged from said outlet throat via a smooth bend and then continuously extended and gradually reduced to said air outlet pipe;

said bent windpipe bends to define a large chamber compared to a small outlet throat and small air outlet pipe in spaced relationship to each other; and said concave check valve is curved toward the direction of the said air exhaust port, and the pivoting direction is contrary to the said bending direction of said bent windpipe so that the small size of air exhaust port under the operation of exhaust air opening said concave check valve and the large size of bent windpipe will achieve noise reduction.

* * * * *